US005294111A

United States Patent [19]

Bloch

[11] Patent Number: 5,294,111

[45] Date of Patent: Mar. 15, 1994

[54] MULTI-PURPOSE FOOTBALL TIMING DEVICE ("RUSH REF")

[76] Inventor: David M. Bloch, 2032 Donald St., Fremont, Nebr. 68025

[21] Appl. No.: 793,992

[22] Filed: Nov. 18, 1991

[51] Int. Cl.[5] ..... A63B 67/00

[52] U.S. Cl. ..... 273/55 R

[58] Field of Search ..... 273/55 R

[56] References Cited

U.S. PATENT DOCUMENTS 3,467,380 9/1969 Bonacci ..... 273/55 R
3,534,958 10/1970 Lipscomb ..... 273/55 R
3,700,238 10/1972 Mathis ..... 273/55 R
3,823,939 7/1974 Bottorff ..... 273/55 R
3,997,160 12/1976 George ..... 273/55 R
4,029,315 6/1977 Bon ..... 273/55 R

*Primary Examiner*—Theatrice Brown

[57] ABSTRACT

An easily portable, impervious to moisture, lightweight multi-purpose football timing device situated at the current line of scrimmage to (i) cradle or hold the football in an elevated position off the ground, (ii) mark the line of scrimmage, (iii) objectively notify both offensive and defensive players, by both audio and visual signals, that the delayed and adjustable time period had expired while at the same time (iv) keeping track of the current down and the (v) current score.

5 Claims, 5 Drawing Sheets

MULTI-PURPOSE FOOTBALL TIMING DEVICE ("RUSH REF")

BACKGROUND

1. Field of the Invention

The present invention relates to an athletic timing device to be used by football players in the game of flag and touch football. Such device incorporates a preset, delayed time for players to rush or cross the line of scrimmage after an audio and/or visual signal to the players, with such device to be placed at the line of scrimmage. Such device both holds and elevates the football and also keeps track of the current down (first, second, third or fourth) and current score of both teams.

2. Description of Prior Art

A delayed rush time is often employed in touch football and flag football games. Problems often arise in objectively signaling both offensive and defensive players of the elapsing of the rush time when the defensive players can cross the line of scrimmage and pursue the quarterback or offensive player holding the ball and, conversely, when the offensive player can advance the ball by means of running across the line of scrimmage. Prior to the elapsing of said rush time, the only means by which the offensive team could advance the ball was by passing to a receiver or player already across the line of scrimmage. Another common problem in these types of football games is marking the current line of scrimmage as well as keeping track of the current down and current score at the line of scrimmage.

Prior inventions appear to be limited to those that hold the football in a snap plate, attempting to keep the ball clean and dry (U.S. Pat. No. 3,809,399 by Thomas Cuprak—1974, a devise for automatically elevating the football throwing efficiency of a passer (see U.S. Pat. No. 4,029,315 by Michel- Julien- Marius- Auguste Bon-1975) and a devise for developing football passing proficiency (see U.S. Pat. No. 3,534,958 by W. W. Lipscomb-1970. The prior art or inventions, however, do not address any form of rush time or time delay audio and/or visual signals to the players as to when the line of scrimmage can be crossed nor do those devises incorporate keeping tract of the current score and down.

There are many advantages to this invention, the primary advantage being the objective notification to both the offensive and defensive players, by means of both audio and visual signals, of the expiration of the predetermined rush time (usually in seconds), with the other advantages to this invention being the cradling of the football in an elevated (above-ground) position while keeping track of the current down and score as well as the current line of scrimmage.

OBJECTS AND ADVANTAGES

Accordingly, several objects and advantages of my invention are as follows, to wit:

(a) to objectively notify both offensive and defensive players, by both audio and visual signals, that the delayed and adjustable rush time period has expired; and (b) cradling and holding the football in an elevated, above-ground position, the football can be easily removed by the offensive player thereby activating the timer for the said audio and visual signals; and (c) keeping track of the current down at the line of scrimmage; and (d) keeping track of the current score at the line of scrimmage; and (e) keeping track of the current line of scrimmage.

Further objects and advantages of my invention will become apparent from a consideration of the drawings and ensuing description of it.

DRAWING FIGURES

There are four pages of drawings referring to five different views or figures of the invention.

FIG. 1 generally depicts the entire invention from the front and left sides thereof, showing the football cradle/time delay activating switch, the down marker turn wheel/numbers, and the one of the two score keeping (left side) turn wheels and numbers. FIG. 1 provides a general overview of the invention.

FIG. 2 depicts the front view of the invention with football resting in the cradle. FIG. 2 also depicts said down marker turn wheel numbers and the two sets of score keeping turn wheels.

FIG. 3 depicts the rear view of the invention with the football resting in the cradle. FIG. 3 also depicts the two sets of scorekeeping turn wheels and also shows the audio signal along with the off and on/multi positional timing switch. FIG. 3 also shows the location of the four, "D" cell batteries in the "legs" of the device.

FIG. 5 also shows the two rear scorekeeping turn wheels, the off and on/multi positional timing switch, the four "D" cell batteries and appropriate wiring and electrical connection plates.

REFERENCE NUMERALS IN DRAWINGS

| | | | |
|---|---|---|---|
| 11 | football | 20 | scorekeeping turn wheels |
| 12 | front half of invention | 21 | shoulder display score numbers |
| 13 | back half of invention | 22 | audio signal |
| 14 | base plate | 23 | timing device/three position switch |
| 15 | slide door | 24 | light signal/ activation switch |
| 16 | cap bill | 25 | contact plates |
| 17 | top depression cradle-football (head) holder | 26 | spring(s) (loaded) |
| 18 | down turn wheel | 27 | wires |
| 19 | down numbers | 28 | batteries |

Description—FIGS. 1 to 5

Figure 4:
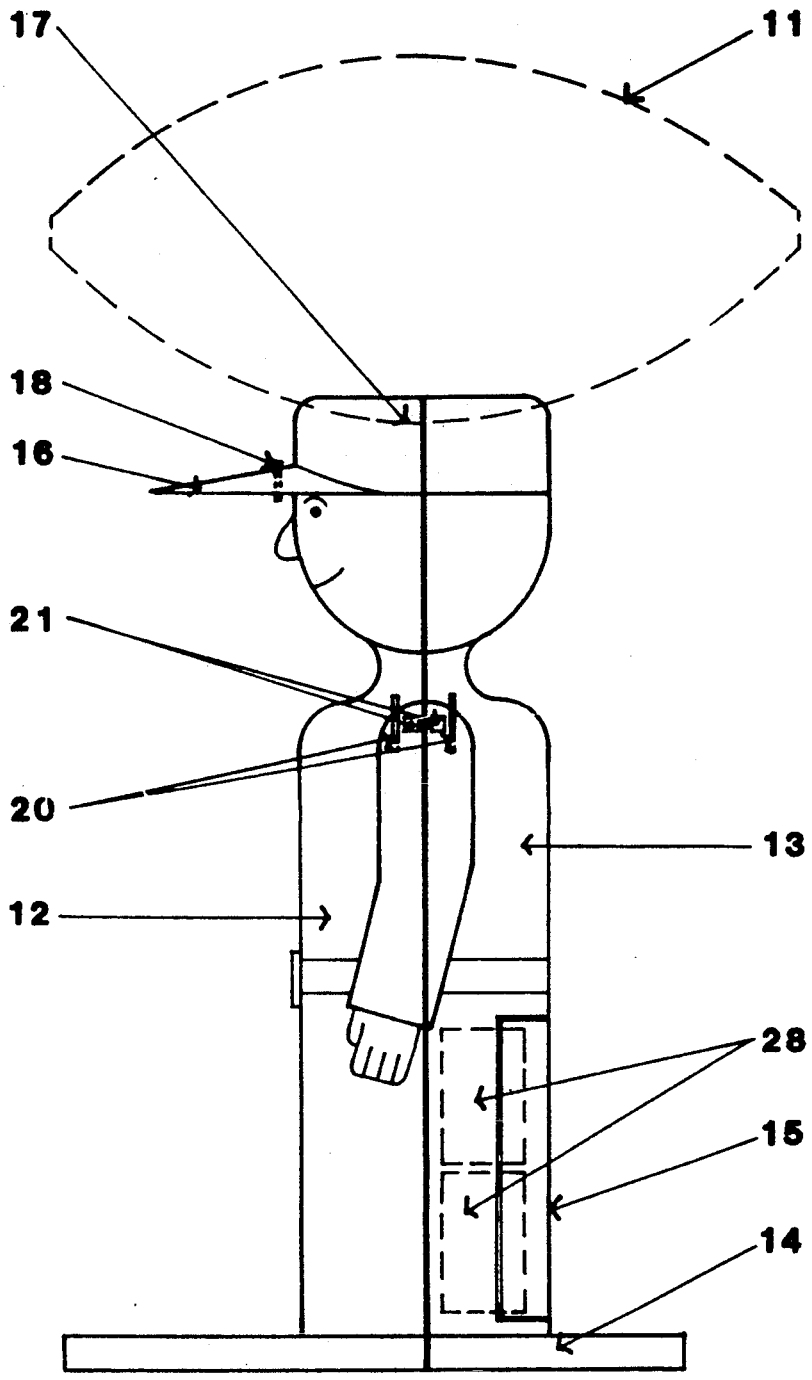
FIG. 4 shows the left, side view of the invention holding the football, with the front and back halves of the invention in place. Said FIG. 4 also shows the left side view of the turn wheel for downs as well as the left side scorekeeping turn wheels/numbers and the slide plate battery cover and two of the four batteries housed in the left "leg" of the invention.

Referring now to the drawings, the device or invention is illustrated on a reduced scale in FIG. 4 wherein a football 11 is shown supported in the top depression (cradle) 17, on a front half body (invention) 12, and back half body (invention) 13, which is supported by a base plate 14. The unit itself is designed to be easily moved by hand to mark the continuously changing line of scrimmage.

Figure 5:
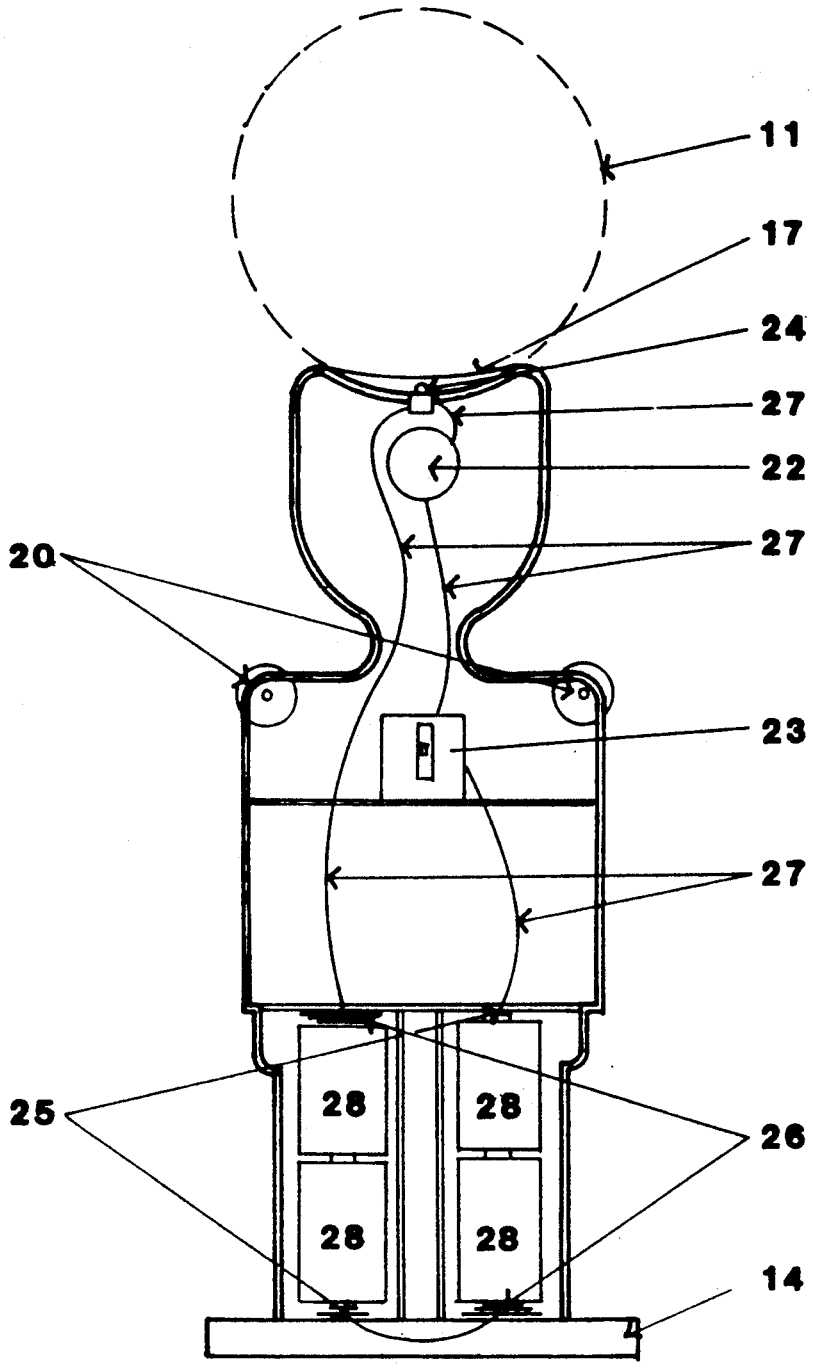
FIG. 5 is a cross-sectional back view which shows the football in place in the cradle depressing the activation switch/light signal and audio signal.

In FIG. 5, the football 11 is shown supported in the top depression (cradle) 17, said football depressing the combination activation switch 24 that readies the device for activation. Once the football 11 is removed (and snapped to the quarterback/offensive player), the combination activation switch 24, said switch 24 being spring loaded, then rises up activating a timing, three-position (first position is off, second position is "college setting" or approximately six seconds, and the third position is "pro setting" or approximately three seconds) device 23 which, after a predetermined time has expired, sounds both an audio signal 22 and a light signal 24 for approximately five seconds. After the activation of the audio and visual signals, the defensive players may cross the line of scrimmage to pursue/tackle/chase the offensive player holding the ball and, conversely, the offensive player can then advance the ball across the line of scrimmage by means of running.

In FIG. 5 after the snap (or release of the ball from the top cradle 17) but before the activation of the audio signal 22 and light signal 24, the only way the offensive player may advance the ball across the line of scrimmage is by means of passing the football to another player that has already crossed the line of scrimmage.

Figure 1:
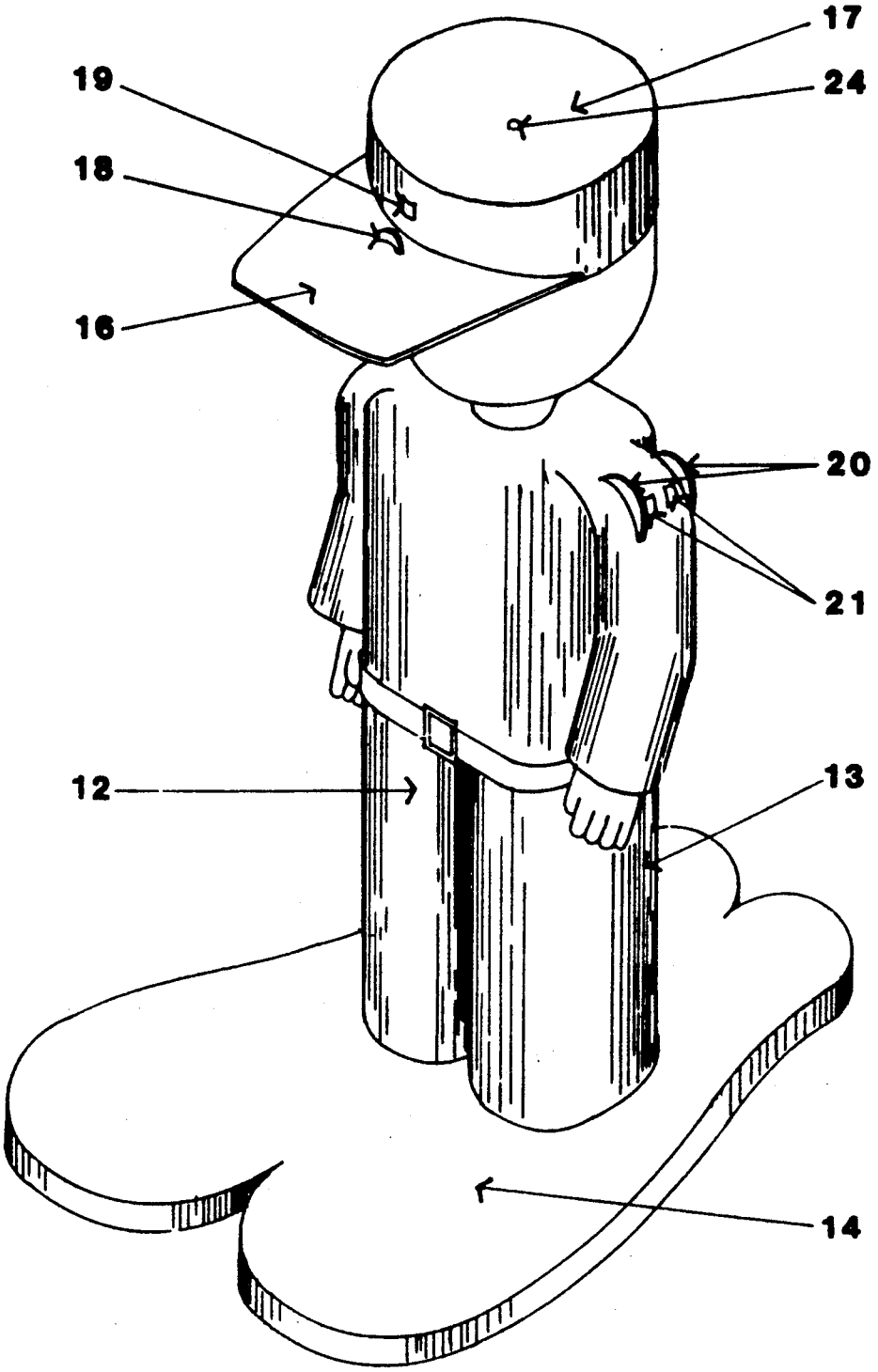
Figure 2:
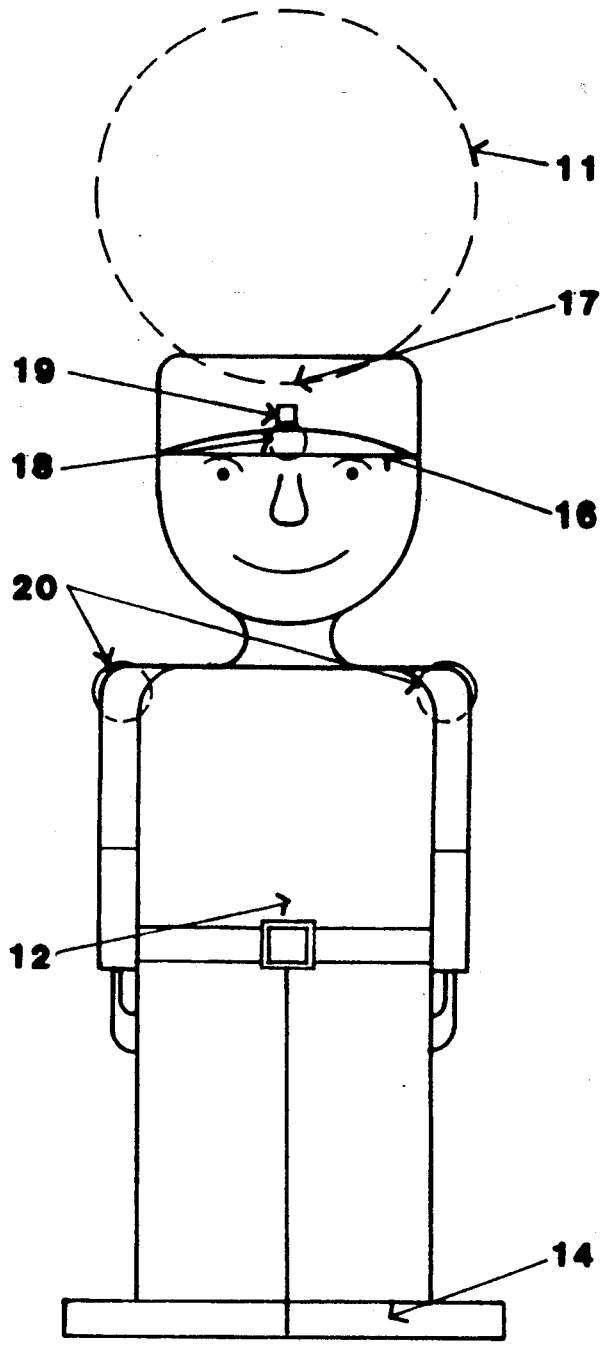
Figure 3:
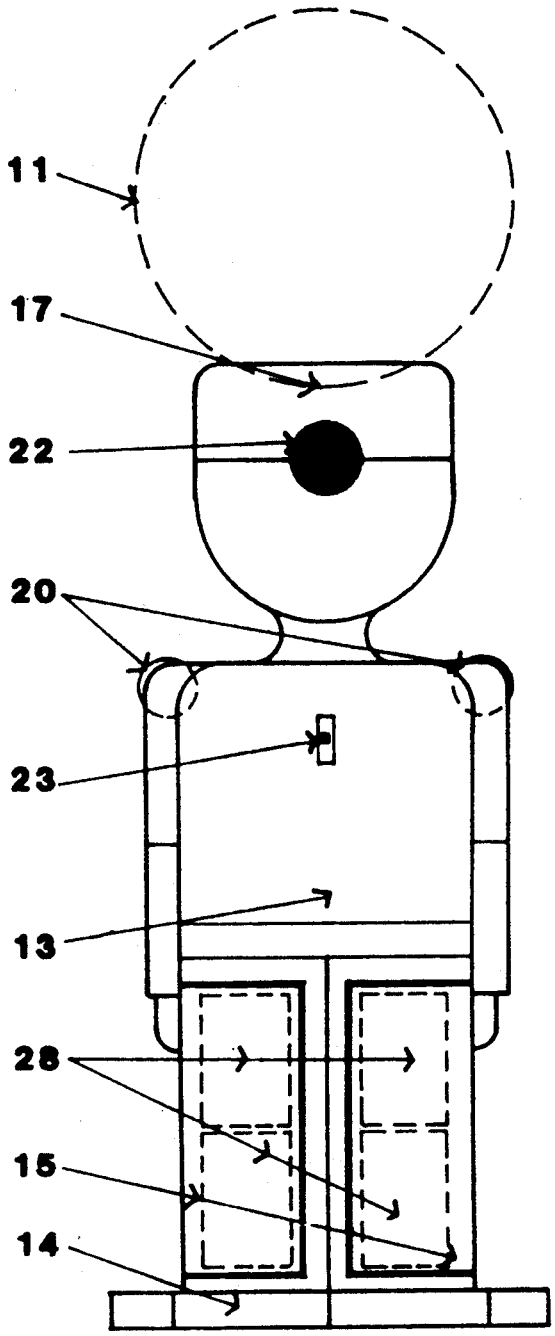

The object in FIG. 1 is made to resemble a football referee. The object will be made of lightweight, moisture impervious material (ordinarily plastic or similar such material). The object (FIG. 1) can be easily carried by hand and would be free of any sharp edges (all edges would be intentionally rounded or curved). The scorekeeping turn wheels 20 are located on both "shoulders" of the invention, with numbers 21 reflecting the score (for each respective team) from zero to ninety-nine.

In FIG. 1 the down marker consists of a turn wheel 18 and a display window 19 displaying numbers one through four representing the appropriate down.

In FIG. 5 the power source will consist of four, "D" cell batteries 28 which will be housed in the "legs" of FIG. 4 behind slide door 15, with two batteries 28 (in a vertical position or one on top of the other) in each "leg". Said batteries 28 in FIG. 5 will be spring loaded 26 and connected via a series through contact plates 25, with the series being completed via wires 27 connecting the timing device 23, the audio signal 22 and the combination activation/light switch 24.

Operation—FIGS. 1, 2, 3, 4 and 5

The multipurpose football timing device will be placed at the line of scrimmage commencing with the first play of the football game at essentially the same place of the offensive center. The device itself is activated by moving the timing devise/three position switch 23 from off to either the "college setting" (which is approximately a six second time delay) or the "pro setting" (which is approximately a three second time delay). The device is activated when the football is placed in the cradle 17 on the top of the device thereby depressing the spring loaded activation/light switch 24.

At the beginning of the offensive play, the appropriate offensive player removes the ball from the cradle 17 thereby starting the timing sequence in the timing device/three position switch 23 and upon the expiration of the appropriate time period, both the audio 22 and visual 24 signals are activated (for approximately five seconds), thereby notifying both teams that the appropriate time period has elapsed. After the activation of the audio and visual signals, the defensive players may cross the line of scrimmage to pursue/tackle/chase the offensive player holding the ball and, conversely, the offensive player can then advance the ball across the line of scrimmage by means of running. The device is then moved to the new line of scrimmage (with the "face" of the device pointed toward the defensive team), the down turnwheel 18 is changed to the appropriate down number 19 when the football 11 is again placed on the cradle 17 readying the machine for the next play.

When a team scores any points, the appropriate score for the appropriate team is placed and displayed by moving the scorekeeping turn wheels 20 displaying the score numbers 21 located on both "shoulders" of the device.

The device will be placed on the sidelines after a team has scored. After the kickoff, the devise will then be brought back out to the field at the commencement of the first play of the offensive team.

The device houses four "D" cell batteries 28 which are inserted before the device is used by opening the slide door 15 and inserting the batteries 28 in the proper position.

Summary, Ramifications, and Scope

Accordingly, the reader will see the many advantages to this multi-purpose football timing device, the primary function being the objective notification of both the offensive and defensive players, by both audio and visual signals (which will also benefit hearing impaired individuals), of the expiration of a delayed and adjustable time period. At the same time, the device will cradle and elevate the football off the ground at the line of scrimmage, while keeping track of the current down and the current score of both teams.

Although the above description contains many specificities, these should not be construed as limiting the scope of the invention but as merely providing illustrations of the suggested embodiment of this invention. For example, the invention cold be reshaped to resemble (other than a football referee), a football player, a spectator, a football itself or other appropriate form or figure. Additionally, the delayed time periods could be further modified than as described.

Accordingly, the scope of the invention should not be limited by the examples given, but should be determined by the appended claims and their legal equivalents.

I claim:

1. A football game timing device comprised of an upstanding frame having a top portion, a middle portion and a base support portion; said frame being in the form of a human figure wherein said top portion is substantially in the form of a human head, said middle portion is substantially in the form of a human torso and legs and said base portion is substantially in the form of human feet; said top portion having a curved upper surface, said curved upper surface having a radius such that a football may be cradles therein until removed by a player, said curved upper surface having a spring loaded switch means mounted therein, said switch means being operated upon a football being placed in and removed from said curved surface, said human figure having mounted therein means for producing an audible signal and means thereon for producing a visual signal, means in said human figure for activating said audible and visual signals when a football is removed from said curved upper surface; timing means having means for controlling the interval of time between removing a ball from said curved surface and actuation of said audio and visual signals; said time interval being a predetermined time set for college football play and a predetermined time set for professional football play, said predetermined time for professional football play being laser than said predetermined time for college football play; circuit means connecting said audible signal means, said visual signal means, said timing means and said activating means; means mounted on said torso for displaying the game score and the down numbers as used in regulation football games.

2. The football game timing devise as defined in claim 1, wherein said circuit means is an electrical circuit and said activating means is at least one battery.

3. The football game timing devise as defined in claim 1, wherein said visual signal is an electric light and said audible signal is a speaker.

4. The football game timing devise as defined in claim 1, wherein said means for controlling is a three position switch, wherein a first position is off, a second position determines said predetermined time interval for college football play and a third position determines said predetermined time interval for professional football play.

5. The football game timing devise as defined in claim 1, wherein said score display means and said down display means are manually operable.

* * * * *